US006519829B1

(12) United States Patent
Kuhlmann et al.

(10) Patent No.: US 6,519,829 B1
(45) Date of Patent: Feb. 18, 2003

(54) METHOD AND DEVICE FOR PRODUCING A COMPOSITE ELEMENT FROM A CERAMIC INNER PART AND A METAL JACKET

(75) Inventors: Heinz-Jürgen Kuhlmann, Oberhausen (DE); Eberhard Heimann, Bad Hönningen (DE); Klaus-Guido Ruwier, Bad Hönningen (DE)

(73) Assignee: Wulfrath Refractories GmbH, Hilden (DE)

( * ) Notice: Subject to any disclaimer, the term of this patent is extended or adjusted under 35 U.S.C. 154(b) by 0 days.

(21) Appl. No.: 09/857,961

(22) PCT Filed: Dec. 14, 1999

(86) PCT No.: PCT/EP99/09922

§ 371 (c)(1),
(2), (4) Date: Dec. 6, 2001

(87) PCT Pub. No.: WO00/35831

PCT Pub. Date: Jun. 22, 2000

(30) Foreign Application Priority Data

Dec. 14, 1998 (DE) ..... 198 57 639

(51) Int. Cl.[7] ..... B23P 11/02
(52) U.S. Cl. ..... 29/447; 29/800
(58) Field of Search ..... 29/447, 446, 722, 29/799, 800

(56) References Cited

U.S. PATENT DOCUMENTS 4,620,350 A * 11/1986 Thurber ..... 29/800
4,759,110 A 7/1988 Rieger et al.
5,152,048 A * 10/1992 Bruckner et al. ..... 29/447

FOREIGN PATENT DOCUMENTS

DE 35 38 421 A1 5/1987
DE 196 53 747 A1 6/1998

* cited by examiner

*Primary Examiner*—David P. Bryant
(74) *Attorney, Agent, or Firm*—Proskauer Rose LLP

(57) ABSTRACT

According to known methods for producing a composite element from a truncated cone-shaped, fire-proof ceramic insert which is enclosed by a metal jacket, the outer jacket is-heated separately and shrunk on the cold ceramic insert. Alternatively, after inductive heating of the outer jacket the ceramic insert, which is heated at the same time, is positioned in the metal jacket using a mechanical device. The invention aims to provide a new method which avoids the disadvantages associated with shrinking a separately heated hot metal jacket on to a colder ceramic insert and to provide a simple method which without inductive heating of the metal jacket and the use of mechanical devices for joining said jacket to the ceramic insert achieves an even bond between the metal jacket and ceramic insert. To this end the fire-proof insert is first introduced into the metal jacket and the conical metal jacket, which rests on a support such that its opening having the smaller diameter points downwards, is then heated from the outside. During heating the ceramic insert and metal jacket remain in constant contact. After they have been heated to a sufficiently high temperature the ceramic insert slides down by force of gravity in such a way that it expands the metal jacket and moves into the bonded position. The above composite elements are used in gas stirring systems during the production of pig iron and steel.

3 Claims, 4 Drawing Sheets

METHOD AND DEVICE FOR PRODUCING A COMPOSITE ELEMENT FROM A CERAMIC INNER PART AND A METAL JACKET

The invention relates to a procedure for manufacturing a composite element out of a truncated, cone-shaped, fire-proof ceramic insert, which is enclosed by a metal jacket, as well as to a device for executing the procedure.

Such composite elements can be used in gas rinsing systems during pig iron and steel production. During the treatment of molten metals in secondary metallurgy, inert gases such as argon or nitrogen are blown into the melt through gas rinsing systems as an important step. The mild to intensive rinsing of the melt better dissolves added alloys, and the composition and temperature of the melt are balanced out. The gas rinsing systems can be incorporated in the floor or lateral wall of the metallurgical vessel, for example a steel treatment pan. Numerous embodiments are known for gas rinsing systems.

Gas rinsing stones normally consist of a gas supply device, a gas distribution area, a ceramic rinsing cone and, if necessary, a metal jacket. The gas rinsing stone is predominantly incorporated into a perforated brick in the fire-proof lining, for example into the pan floor or a sleeve, which are in turn walled or banked in the fire-proof lining. So that the rinsing stone can be replaced from outside during the pan campaign, use is usually made of a truncated, cone-shaped rinsing stone cone in which the face with the smaller diameter is directed at the interior of the pan.

There are different basic designs to enable the throughput of gases through the rinsing stone. For example, changes are introduced in the structural design of the ceramic part, or cauterization materials are added, which bring about an increased porosity during ceramic firing, or the ceramic insert is provided with fine gaps or channels in an otherwise impervious ceramic body, or gas is supplied through an annular gap between an impervious ceramic cone and an encasing metal jacket. Combinations of various embodiments are also possible.

In order to generate fine gas bubbles for stirring the molten metal, embodiments of gas rinsing stones are preferred in which the ceramic insert consists of porous, fire-proof material, or has fine channels with a small diameter or slits ("directed porosity"). In this case, it is required that the metal jacket fits uniformly tight against the ceramic insert over the entire circumference and its entire length. If at all possible, gas is to be prevented from passing between the metal jacket and wall of the ceramic insert. Even given progressive wear over time, gas is to pass through the interior of the ceramic insert in as a distribution defined as possible. A nonuniform passage of gas at the edge of the ceramic insert must be avoided if at all possible.

Known from DE 196 53 747 A1 is to heat the metal jacket using an induction coil secured in a bell type furnace and then shrinking it onto the ceramic insert. The disadvantage is that placing the glowing metal jacket on the ceramic insert at excessive temperature differences can cause cracks to form in the structure of the ceramic insert. On the other hand, the temperature difference cannot be too slight, since the objective is to reliably shrink the metal jacket onto the ceramic insert. To this end, DE 196 53 747 A1 proposes that the metal jacket encases the ceramic insert at a distance without contacting it inside a bell type furnace with induction coil, and heating it via radiated heat. The metal jacket and ceramic insert are to be brought together right after the metal jacket has been heated.

Heating takes place inside an inductor by means of inductive heating in the procedure known from DE 40 21 259 A1 as well. Only the outside jacket can be heated inductively. The inner ceramic part is positioned inside the metal jacket using a hoisting device.

The object of the invention is to avoid the disadvantages while shrinking a separately heated, hot metal jacket onto a colder ceramic insert, and achieve a uniform bond between the metal jacket and ceramic insert in a simple procedure, without inductively heating the metal jacket, and without using mechanical devices to bring it together with the ceramic insert.

The object is achieved according to the invention in a procedure of the kind mentioned at the outset by first sliding the fire-proof insert into the metal jacket, heating the conical metal jacket with the opening having the smaller diameter facing down on a substrate from outside, wherein the ceramic insert and metal jacket always remain in contact, and heating to a temperature high enough that the ceramic insert shifts downward into the composite position solely under its own weight with the metal jacket expanding.

It was found that no additional forces need to be exerted by means of a mechanical device to press the ceramic insert into the metal jacket while the latter expands open. This is accomplished solely by the weight of the ceramic insert.

As a result, the metal jacket exerts a particularly uniform compressive stress on the ceramic insert after cooling. This is advantageous, since the metal jacket can in this way support the fire-proof ceramics during use as a gas rinsing stone, which reduces the susceptibility to cracking of the rinsing stone, and ensures that the rinsing gas only passes through the stone into the melt on the prescribed path.

One advantageous embodiment of the procedure can be characterized by the fact that the metal jacket with the ceramic insert accommodated therein rotates around the perpendicular axis during the heating process. The uniform rotation at a defined distance from the heating device achieves a particularly uniform heating of the metal jacket. The heating device preferably consists of numerous burner flames, which can be distributed over the height of the metal jacket. In addition, burner flames can be distributed over the circumference of the metal jacket.

The device according to the invention will be described below based on an embodiment.

Figure 1:
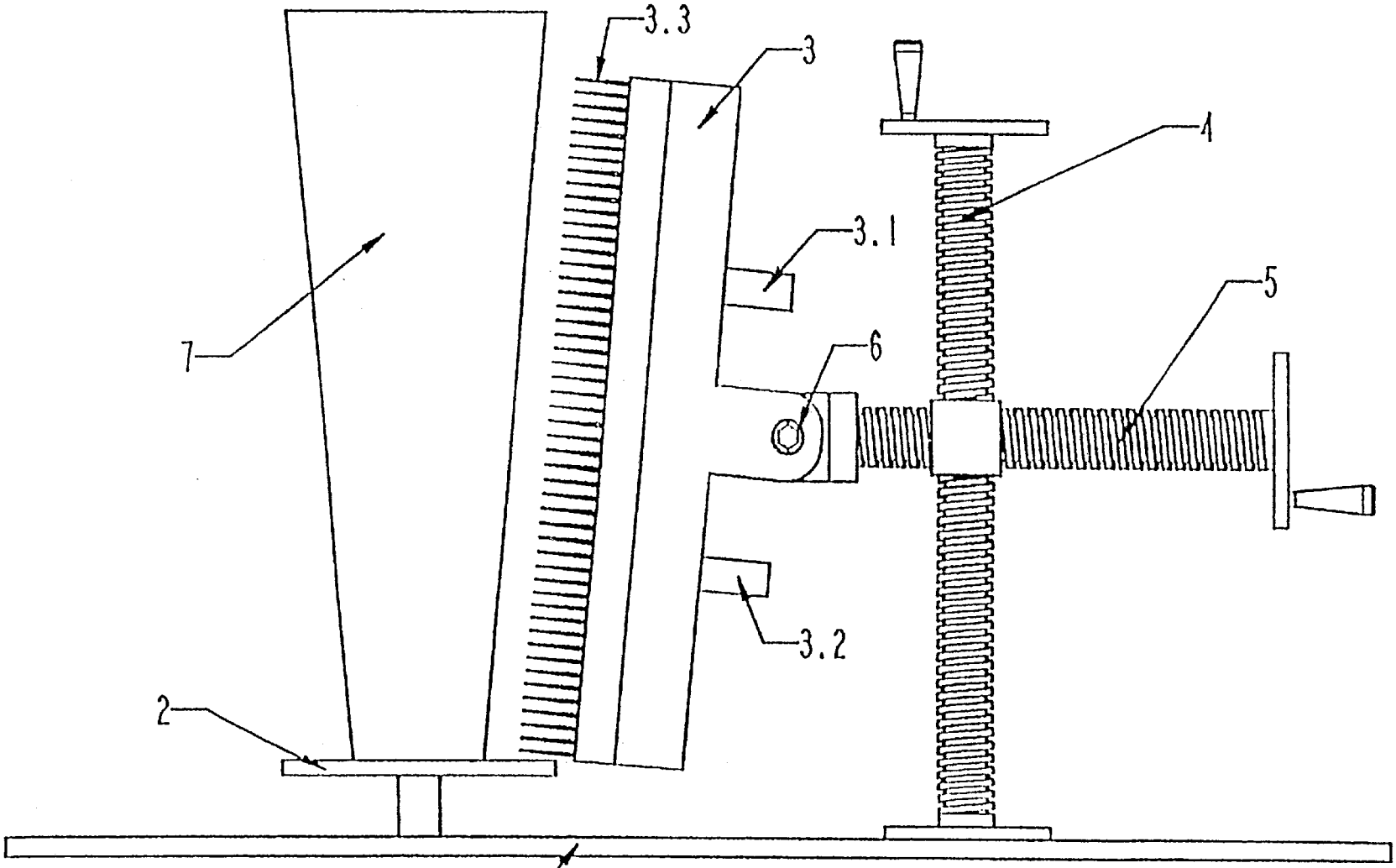
FIG. 1 shows a schematic view of the device.

In the view shown on FIG. 1, on the left a rotary table (2) that can be rotated around the vertical axis is arranged on the base plate of the worktable (1). The conical composite element (7) sits perpendicularly on the rotary table (2), wherein the face with the smaller diameter points downward. The composite element (7) consists of the metal jacket (8) and ceramic insert (9). A stand (4) is located on the worktable (1) to the right. An additional height-adjustable rod (5) is horizontally situated on the perpendicular stand rod. A burner strip (3) is secured to this horizontal transverse rod (5) on the end facing the rotary table (2). The burner strip (3) can be horizontally moved by adjusting the lateral adjusting means of the transverse rod (5) in order to set the distance to the rotary table (2). Since it is secured to the transverse rod (5) by a hinge (6), its inclination relative to the vertical can also be adjusted to the cone of the composite element (7).

Fuel, e.g. natural gas, is supplied via the connecting piece (3.1). The side of the burner strip (3) facing the composite element (7) is provided with numerous gas outlets, which enable numerous burner flames (3.3) distributed over the entire length of the burner strip (3). The burner strip (3) can additionally be supplied with oxygen via the connecting piece (3.2).

Figure 2:
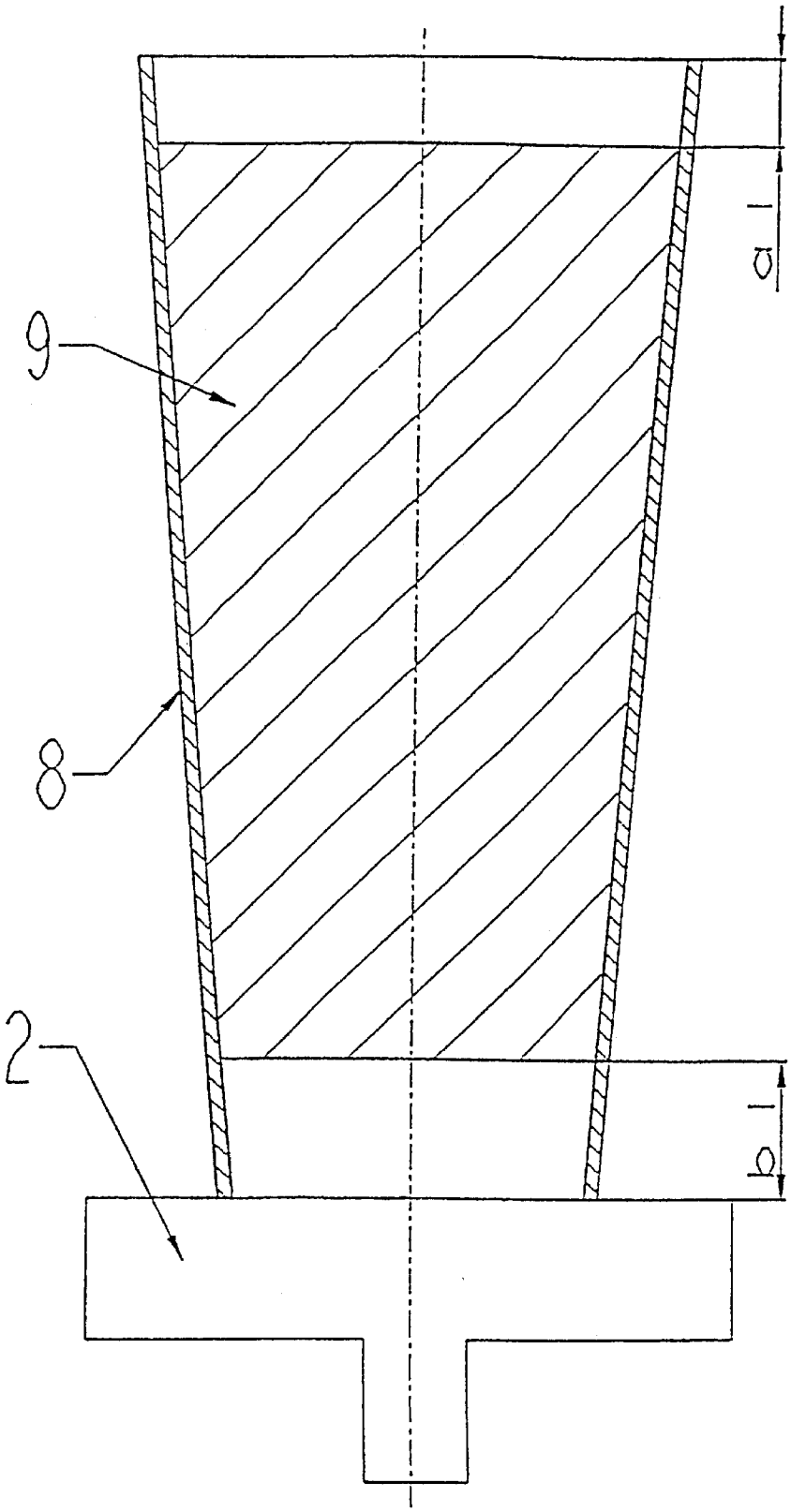
FIG. 2 shows a longitudinal section through the arrangement of a rotary table, metal jacket and ceramic insert incorporated therein prior to heat treatment.

As shown on FIG. 2, the conical ceramic insert (9) has the same conicity as the metal jacket (8). The ceramic insert (9) is here shorter than the metal jacket (8), so that the metal jacket (8) projects over the ceramic insert (9) on both faces. The face with the smaller diameter points down toward the rotary table (2). In the initial state prior to heat treatment, the face with the smaller diameter is spaced apart from the lower edge by distance "b1". At the top, the metal jacket (8) projects over the face with the larger diameter by distance "a1". The ceramic insert (9) and metal jacket (8) are connected under exposure to weight.

As the process of manufacturing the composite element (7) begins, the rotary table (2) bearing the metal jacket (8) that accommodates the ceramic insert (9) is made to rotate. The burner is then lit. The burner flames (3.3) heat the metal jacket (8) uniformly. The burner flame (3.3) must here be set in such a way that the metal jacket (8) reaches a uniformly high temperature so as to expand under exposure to the weight of the ceramic insert (9).

Figure 3:
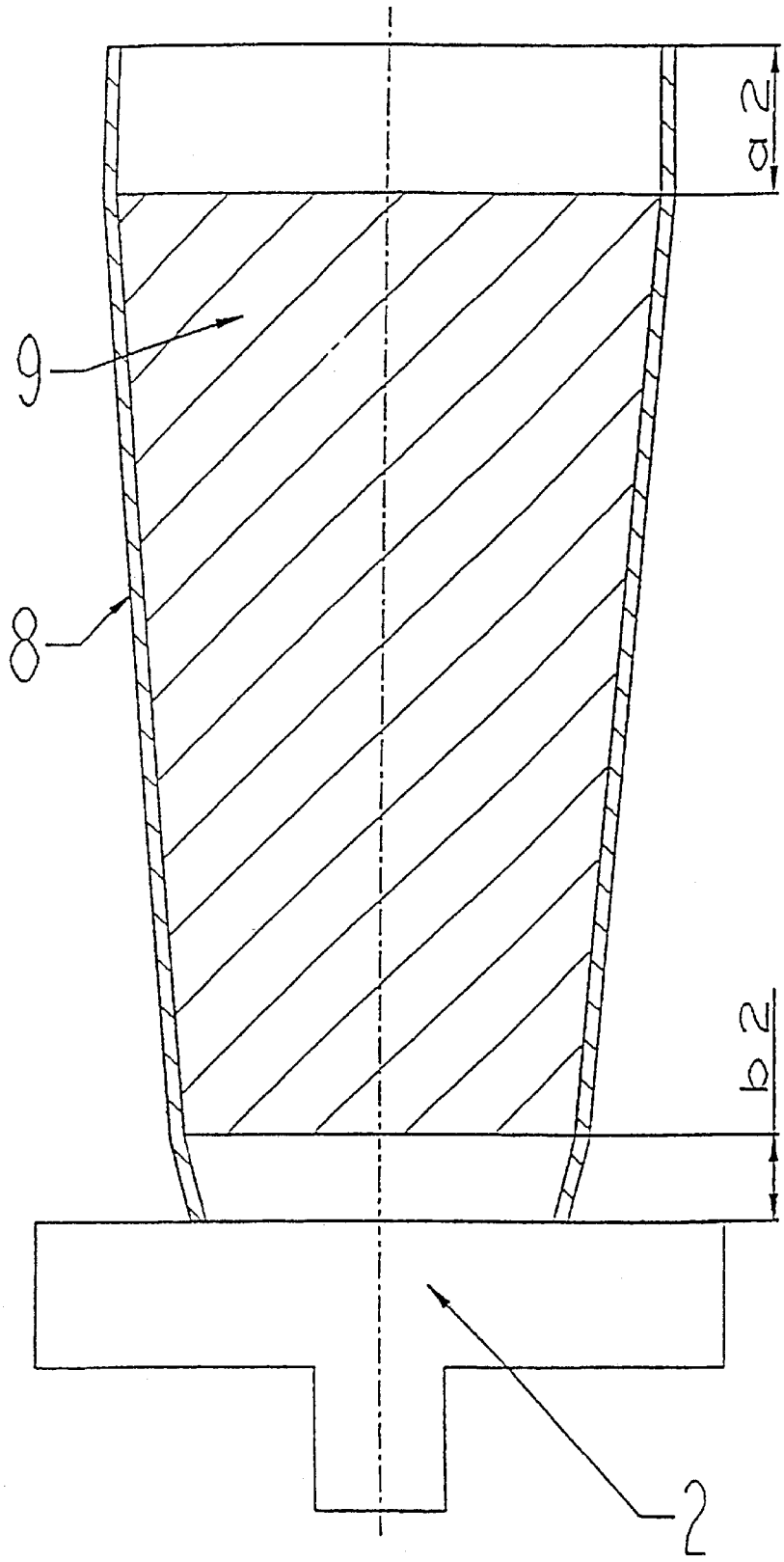
FIG. 3 shows a longitudinal section of the state after heat treatment.

The ceramic insert (9) changes its position in the composite element (7) in the process. The distance to the lower edge diminishes. FIG. 3 shows a schematic view of the state following heat treatment of the metal jacket (8). The distance from the lower edge "b2" is now smaller than "b1" before heat treatment. The distance "a2" at the upper edge has increased relative to "a1" in the initial state to the same extent.

Once the burner is turned off, the metal jacket (8) starts to cool immediately, and then exerts a compressive stress on the ceramic insert (9). The procedure according to the invention results in a composite element in which the metal jacket (8) tightly encases the ceramic insert (9), and fixes it in place.

Figure 4:
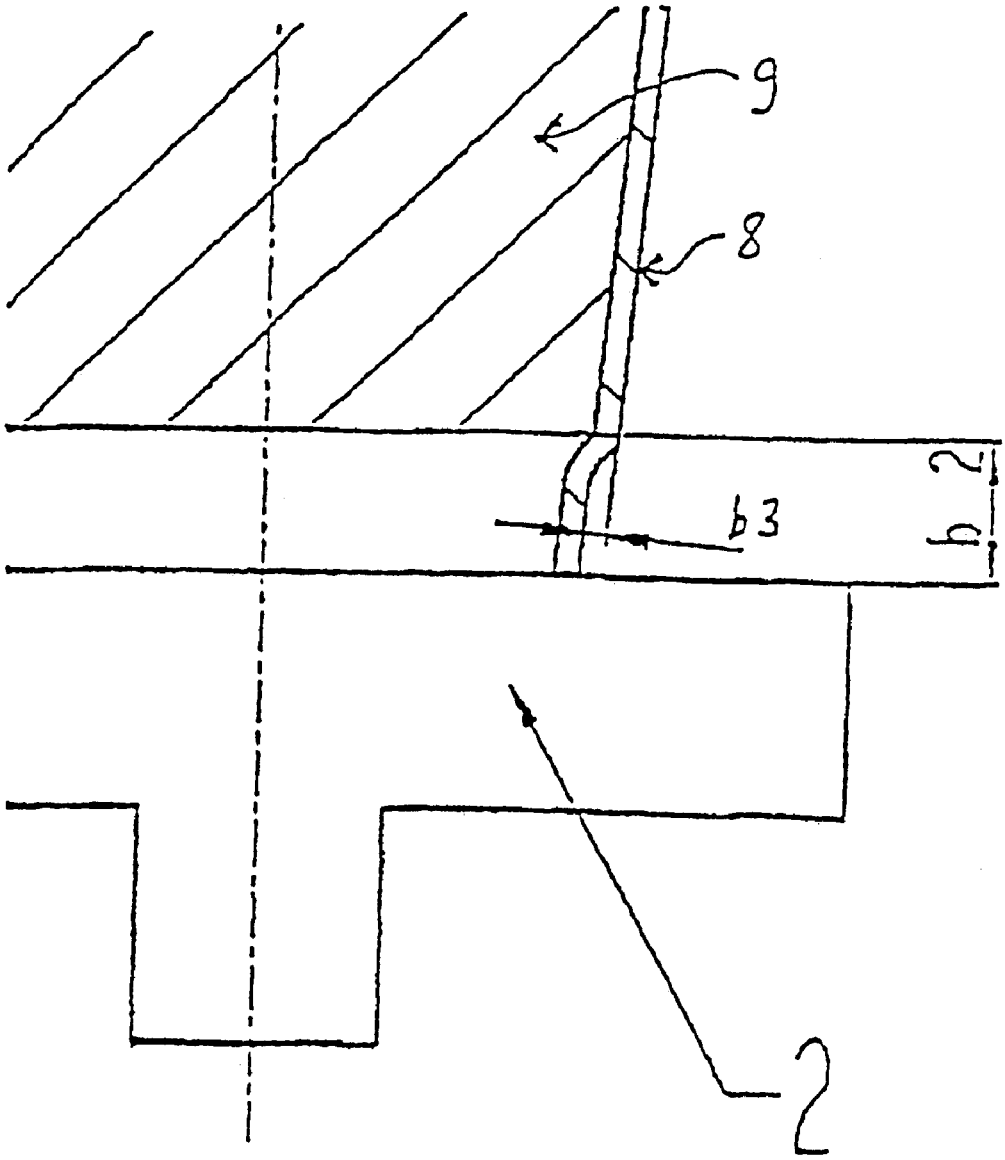
FIG. 4 shows a detail at the lower end of the rinsing stone.

Typical for a composite element manufactured with the procedure according to the invention is the recess on the lower edge of the metal jacket (8) standing on the rotary table (2), as shown on FIG. 4. Below the ceramic insert (9), the metal jacket (8) is drawn somewhat inward toward the middle axis. The difference "b3" between the radius at the point to which the ceramic insert (9) extends, and the radius at the lower edge of the metal jacket (8) on the rotary plate (2) measures about 1.5 to 2%.

The conventional configuration of the finished gas rinsing stone is not shown. Normally, a floor panel provided with a connecting sleeve for gas supply is welded to the cone with the larger diameter, which faces to the outside when placed in the pan floor or pan wall.

Experience gained in practice has shown that the temperature to which the metal jacket, e.g., a stainless steel sheet, is to be heated measures about 900° C. Given a sufficiently powerful burner, a heating time of approx. 20 seconds is entirely sufficient as a characteristic value. If desired, a visual check can be performed to verify that heating is uniform. The ceramic insert then moves down approx. 10 mm. The metal jacket expands by 1%.

What is claimed is:

1. A procedure for manufacturing a composite element out of a truncated, cone-shaped, fire-proof ceramic insert (9), which is enclosed by a conical metal jacket (8), characterized by the fact that the fire-proof insert (9) is first inserted into the metal jacket (8), the conical metal jacket (8) with the opening having the smaller diameter facing down on a substrate is heated from outside, wherein the ceramic insert (9) and metal jacket (8) always remain in contact, and that the ceramic insert (9) shifts downward into a composite position within the metal jacket solely under its own weight with the metal jacket (8) expanding.

2. The procedure according to claim 1, characterized by the fact that the metal jacket (8) accommodating the ceramic insert (9) rotates around its vertical axis during the heating process.

3. The device for manufacturing a composite element out of a truncated, cone-shaped, fire-proof ceramic insert, which is enclosed by a metal jacket, for executing the procedure according to claim 1, characterized by a rotary plate (2), on which the metal jacket (8) with ceramic insert (9) incorporated therein sits, with a burner strip (3) and means for setting the inclination of the burner strip (3) and distance between the metal jacket (8) and burner flames (3.3).

* * * * *

UNITED STATES PATENT AND TRADEMARK OFFICE

CERTIFICATE OF CORRECTION

PATENT NO. : 6,519,829 B1 
DATED : February 18, 2003
INVENTOR(S) : Dr. Heinz-Jürgen Kuhlmann et al.

It is certified that error appears in the above-identified patent and that said Letters Patent is hereby corrected as shown below:

Title page,
Item [86], (2)(4), the § 371 (c)(1),(2),(4) date of the application should read
-- June 12, 2001 --

Signed and Sealed this

Thirtieth Day of September, 2003

JAMES E. ROGAN
*Director of the United States Patent and Trademark Office*